United States Patent [19]

Ashby

[11] Patent Number: 4,511,231

[45] Date of Patent: Apr. 16, 1985

[54] PROCESSING TANK FOR MAKING PHOTOGRAPHIC CONTACT PRINTS

[76] Inventor: Benjamin F. Ashby, 23942 Paseo del Campo, Laguna Niguel, Calif. 92677

[21] Appl. No.: 569,663

[22] Filed: Jan. 10, 1984

[51] Int. Cl.[3] ..... G03D 9/00; G03D 13/04

[52] U.S. Cl. ..... 354/301; 354/331; 354/338

[58] Field of Search ..... 354/301, 302, 305, 316, 354/320, 331, 333, 335, 337, 338, 339

[56] References Cited

U.S. PATENT DOCUMENTS

| | | | |
|---|---|---|---|
| 3,117,507 | 1/1964 | Limberger | 354/301 |
| 3,236,168 | 2/1966 | Rautbord et al. | 354/338 |
| 3,261,277 | 7/1966 | Limberger | 354/302 |
| 3,621,771 | 11/1971 | Stievenart et al. | 354/320 |

*Primary Examiner*—A. A. Mathews

*Attorney, Agent, or Firm*—Donald D. Mon; David O'Reilly

[57] ABSTRACT

A contact processor with a vertical tank having an upper aperture through which two sheets are passed to be immersed in a solution in the tank, and then withdrawn in contact with one another to transfer an image. Sheet guides deflect the sheets toward and against opposite walls of the tank. Resilient means are positioned at the aperture, so as to press the sheets together when they are withdrawn from the tank. Slots and holes are provided to enable the accurate alignment of the sheets, and the tank walls can be ribbed to lessen the force of attraction of the sheets to the wall.

15 Claims, 4 Drawing Figures

PROCESSING TANK FOR MAKING PHOTOGRAPHIC CONTACT PRINTS

FIELD OF THE INVENTION

This invention relates to the processing of film and paper contact prints, and in particular to a processor for use in such processing.

BACKGROUND OF THE INVENTION

Print processing of the diffusion transfer type involves submerging a paper negative and a receiver sheet into a solution out of contact with one another, and then withdrawing them from the solution in contact or laminated with one another. The sheets are pressed together to remove the solution and to provide the intimate contact of the two sheets which is required for chemical transfer of the image to occur. The product of the correctly accomplished process is an image of very high quality, for example of the type frequently called a "stat", which is a very detailed and fine line high contrast quality image.

Such a process has a number of important inherent requirements, and if any of them is not fulfilled, then a superior product will not be made. For example, the emulsion sides of the sheets must not make contact with one another or any other surface while they are wet with solution, except at the precise moment when transfer is to be made. This contact must be accomplished without "shear" or slip-type motion between them. They can be allowed to make contact with one another while dry before immersion, but permissible contact after immersion is limited to the precise moment of transfer. The pressure applied to press the sheets together and to remove the solution from them must be uniform across the product. The sheets must be protected against being scratched during insertion, processing and removal, and residues especially silver residues, that remain in the system from previous processing must not be entrained.

It should be remembered that this process takes only a relatively short period of time, which time should be kept to a minimum, and is done in a dark room with red safe light. A suitable processor must be simple in construction and easy to use, or spoilage of expensive material is likely to occur. Furthermore, the processor itself should, if possible, be inexpensive to manufacture so that it can be sold at a reasonable price. Also, recovery of silver should be reasonably easy, because it is a high value residue.

In addition, the solution itself presents some difficulties. It is subject to oxidation and evaporation by the air, and the rate of oxidation is rougly proportional to the amount of exposed area of solution. When a horizontal tank is used, there is a large exposed area, which it is difficult to close off from the air to prevent the entry of new oxygen to replace that which has already reacted with the solution. Thus, the rate of oxidation of this costly solution is frequently quite high in conventional processors, and the solution must frequently be replaced.

This invention provides a processor with no part which must be moved during processing, for example, motors or driven rollers, and which overcomes all of the above disadvantages. The processor is inexpensive to manufacture, reliable and easy to use, and because of its vertical orientation presents only a minimal area to air where oxidation occurs. It can be closed to exclude new air, and thereby further reduces chemical costs.

BRIEF DESCRIPTION OF THE INVENTION

A print processor according to this invention includes a vertically oriented tank with an aperture at its upper end through which the sheets are passed when they are inserted into the tank, and through which they pass when they are withdrawn from the tank. The tank holds the developing solution and is provided with a drain port near its lower end.

A sheet guide is mounted to the tank adjacent to the aperture. There it receives the two sheets, which while dry can be in face-to-face contact with one another. A separator separates the sheets from each other as they are shoved into the tank, and sheet guide means guides each sheet toward its respective sidewall. Each sheet slides down its respective sidewall and the sheets are thereby kept spaced apart from one another. The back side of each sheet tends slidingly to adhere to ribs in the tank wall, which is the reason that the sheets do remain separated from one another while in the tank. The sheet guide is removable, preferably pivotably, and compression means such as a pressure bar is adapted to be placed in the aperture, closing it to such an extent that when the sheets are pulled past it, while being withdrawn from the tank, the solution is squeegeed from the sheets, and the sheets are tightly pressed together. This compression means can additionally serve as a closure for the aperture so as to limit or prevent entry of air into the tank.

According to a preferred but optional feature of the invention, the sheet guide includes a slot through and along which a finger of the user can be passed to shove the sheets into the tank. The bottom of the slot is at a precise location relative to the tank so that when the finger reaches the bottom of the slot, the sheets will be submerged to a precise and predetermined depth in the solution.

In addition, two alignment apertures can be provided so that when a finger is placed in each, the upper edges of the sheets will be accurately aligned with one another so the image will be squarely located on the receiver sheet when the two sheets are withdrawn together.

According to yet another preferred but optional feature of the invention, mounting means such as a frame with holes for mounting screws is provided so that the tank can be mounted to the top edge of a table or workbench whereby to occupy only a small area in the workroom.

The above and other features of this invention will be fully understood from the following detailed description and the accompanying drawings, in which:

DETAILED DESCRIPTION OF THE INVENTION

Figure 1:
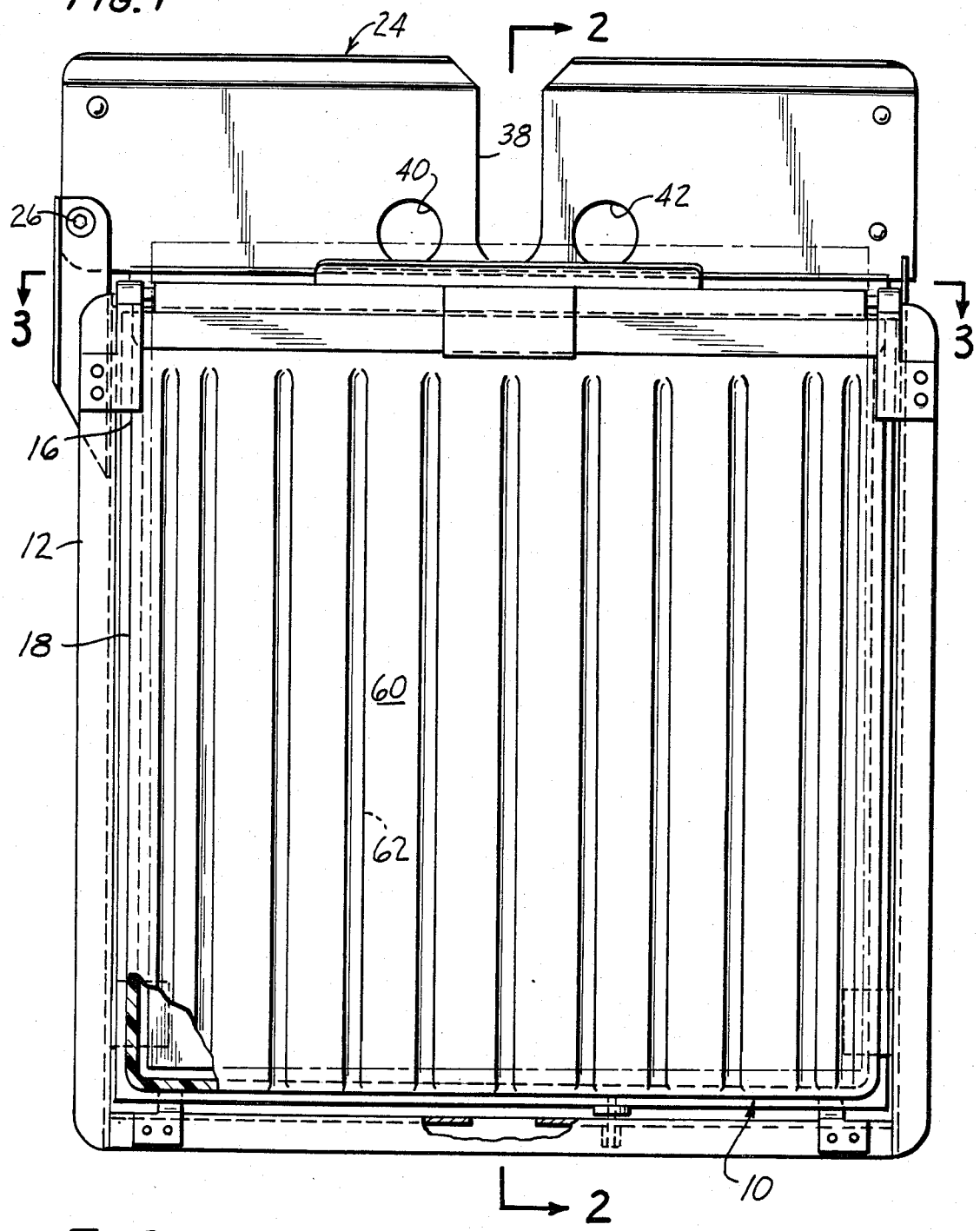
FIG. 1 is a side elevation showing the presently preferred embodiment of a contact print processor according to this invention.
Figure 3:
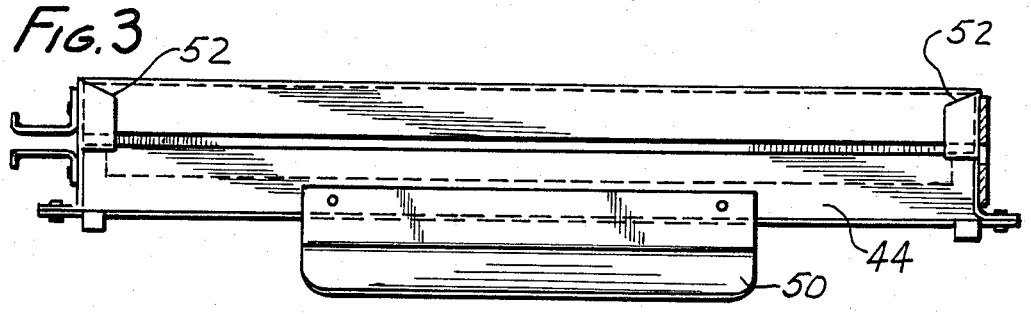
FIG. 3 is a top view taken at line 3—3 FIG. 1.
Figure 2:
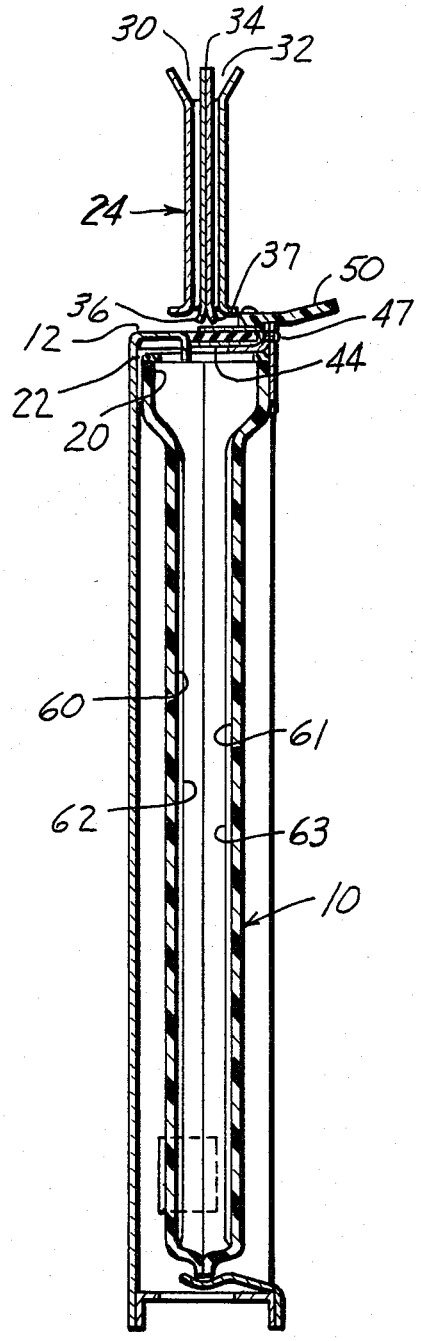
FIG. 2 is a sectional view taken at line 2—2 in FIG. 1.

The contact print processor shown generally in FIGS. 1 and 2 is comprised of an elongated vertical tank 10 mounted in a saddle or frame 12. One side of frame 12 is open, while the rear side has a plate for attaching the processor to a vertical surface such as a work table or bench. Tank 10 readily snaps into and out of frame 12 and is held in place by clip 16 which engages a flange 18 that is formed around the sides of the tank. Tank 10 is made as thin as possible, in order to minimize the quantity of solution which it must hold in order to cover and process the sheets, and also in order to present a minimum surface area of solution to the air in the tank. The tank has an aperture 20 at its top. The upper end of the tank bears against a gasket 22. The gasket is compressed between the upper end of the tank and frame 12.

Sheet guide means 24 is mounted to the tank adjacent to the aperture. It is mounted so that it can be located directly over the aperture. The guide means directs the sheets to and through the aperture. The guide means is movably mounted so it can be removed from its position above the aperture, and put in a location where it does not overhang the aperture. The preferred mounting for the guide means is pivotal or hinged. For example, hinge bracket 26 mounts the guide means for the tank so it can pivot away from the aperture. The sheet guide means has two parallel slots 30,32 separated by separator 34. Separator 34 can be made of a single piece of formed metal, but most conveniently will be made of two sheets of metal. Guide surfaces 36,37 are formed at its lower end. The guide surfaces deflect the separated sheets towad respective opposite walls of the tank. The sheet guide means permits the paper to be shoved into the solution in the tank and to be accurately placed and aligned before they are brought into contact with one another while they are being removed from the tank.

An elongated, open top slot 38 receives the finger of a user to shove the upper edges of the sheets downward so their upper edge is about even with the bottom end of slot 38. The bottom end of slot 38 thereby determines how far into the tank the sheets can be shoved.

Final alignment of the sheets is enabled by holes 40,42 located on opposite sides of the center slot. A finger is placed through each hole, and the fingers are brought down to the bottom edges of the holes. These edges are at the same elevation. Now the top edges of the sheets are squarely aligned in the tank.

After the two sheets have been shoved into the tank and aligned, sheet guide means 24 is pivoted away from the top of the tank as indicated by the arrow, and does not take further part in the processing.

At this time, compression means 44 is inserted in a receptacle 45 formed in the upper end of frame 12. The compression means is held in place by clips 52. The receptacle has a vertical lip or surface 46 against which there bears a straight edge 47 of a resilient member 48 carried by compression means 44. Set screws 49 along the resilient member enable the location of edge 47 to be accurately situated. The compression means is installed or removed simply by pushing up or down on handle 50. It will be noted that the compression means closes the aperture at the top of the tank, and is used as a closure when the processor is not in use. The sheet guide means can be pivoted to overhang the compression means when the compression means is used as a closure, to conserve space. The resiliency of member 48 permits the sheets 53,54 to be withdrawn past it. A compressive squeegee effect is exerted on the sheets by the resilient member as the sheets are pulled past it. The resilient member also bears against a downward flange 13 on the frame when no sheet is between them.

Walls 60 and 61 of the tank are generally rectangular. In use they are vertically oriented. They include a plurality of internal vertically extending ribs 62,63. These ribs are spaced about an inch apart, extend about 3/16 inch from the wall surface, are very smooth, and are gently rounded. When the sheets enter the solution, the sheets are guided toward a respective wall, and they move along the wall, or more precisely, along the ribs, which form part of the wall and cling to it so that they will not contact one another while in the solution.

The sheets while dry are relatively stiff, and can be shoved into the tank without buckling. After they become fully wetted by the solution they become quite flexible and then cannot accommodate too much shoving force without buckling. If they do buckle, then they might make contact with each other and the work would be spoiled. Thus, full area contact between the sheets and the walls would involve a risk because it increases the resistance of the paper to sliding movement along the wall. This would call for increased shoving force and a consequently greater risk of buckling. But if there were not at least some attraction to the wall, the sheets might float toward one another and thereby make spoiling contact. The ribs provide just the right area of wall contact to permit light adhesion of the sheets to the walls, but which does not increase the resistance to sliding to an undesirable extent. The tank is preferably made of a plastic material with a very smooth surface to minimize the resistance to sliding.

Figure 4:
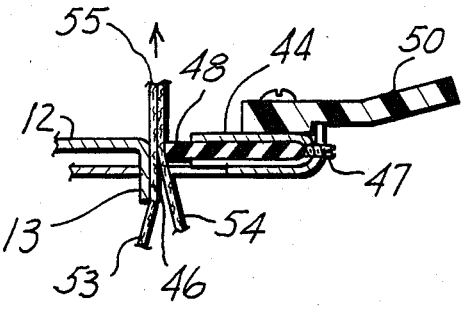
FIG. 4 is a partial sectional view illustrating a function of the processor.

In use, compression means 44 is removed and sheet guide means 24 is swung into place over the tank aperture. The two sheets are simultaneously or separately fed into slots 30 and 32, respectively, in the sheet guide. The deflector members deflect the sheets toward the respective sidewall, and the sheets slide down the walls, or more precisely, slide down the rib portions of the wall. After the sheets are immersed in the solution and aligned by inserting fingers into slot 38 and holes 40 and 42, the compression means 44 is inserted into the receptacle formed in the opposite tank and snapped into clips at either side of the receptacle as illustrated in FIG. 4. The upper ends of the two sheets are now compressed between resilient edge 48 on means 44 and the wall 46 formed in the receptacle, thereby gripping the upper edges of the sheets. Next, the sheet guide is pivoted out of the way. The sheets remain firmly gripped by the compression means.

Portions 55 of the sheets which remained outside of the tank are dry and above the compression means. They are now gripped by the fingers and are upwardly pulled so as to pull the sheets out of the tank. The sheets can swiftly be pulled past the compression means. This means compresses the two sheets together and squeezes out excess developing solution. The exerted pressure is uniform across the sheet because of the resiliency and accurate location of the compression means. The resiliency is partly inherent in the material of the resilience means, and can further be adjusted either by bias springs (not shown), or by tightening or loosening the set screws. The compression means can next be removed by pushing up on handle 50 and snapping it out of the receptacle. The sheet guide may then be pivoted back over the tank aperture and the next pair of sheets can be processed as described above. After the last sheets are processed, the compression means will be left in place as a tank closure.

This invention thereby provides a processor which is simple in construction and operation. Apart from the removability of the sheet guide means and the compression means, there are no moving parts. The construction is elegant in design and operation and is economical to use, and to manufacture.

The device is easy to clean. The silver drops to the bottom, and can be caught in a folded paper or other receptacle. Being at the bottom, it will not contact the photographic paper, thereby avoiding this risk of ruining the sheets.

This invention is not to be limited by the embodiment shown in the drawings and described in the description, which is given by way of example and not of limitation, but only in accordance with the scope of the appended claims.

I claim:

1. A processor for use in contact print processing of sheets of the diffusion transfer type, comprising:

a vertically oriented tank adapted to hold a developing solution, and including a pair of parallel tank walls spaced apart from one another, said tank having an upper aperture;

sheet guide means disposable adjacent to said aperture, said guide means comprising a separator disposed between a pair of parallel slots, which includes a pair of diverging guide members, one adjacent to each said slot, to deflect a respective one of said sheets from the respective slot toward a respective tank wall; and compression means removably disposable adjacent to said aperture, said compression means including a straight-edged resilient member adapted to exert a compressive wiping force on said sheets when they are pulled past said resilient member;

whereby with solution in said tank, said sheets may be shoved through said slots and deflected toward respective tank walls by said guide means, and slide along said walls, after which said sheet guide means is removed and said compression means is disposed as aforesaid, and the upper ends of said sheets are pulled upwardly to draw the sheets past said compression means to press them together and remove the solution.

2. A processor according to claim 1 in which said sheet guide means is pivotally mounted to said tank so as to be movable to said position adjacent to said upper aperture, and to be pivoted away therefrom.

3. A processor according to claim 1 in which said parallel tank walls are surfaced by upwardly-extending ribs, which reduce the area of contact of said sheets against said wall to less than the total area of said sheets.

4. A processor according to claim 1 in which said sheet guide means includes a slot extending from the top thereof to an elevation at the bottom of the slot such that, when the top edge of the sheet is at said elevation, its bottom edge is correctly located above the bottom of the tank.

5. A processor according to claim 4 in which said sheet guide means includes a pair of openings with bottom portions at said elevation, whereby when the upper edge of the sheets are at said bottom edges, the sheets are squarely aligned with one another.

6. A processor according to claim 1 in which said resilient member is adjustably mounted so that its edge can be made accurately parallel to an opposite straight surface in said aperture.

7. A processor according to claim 6 in which a plurality of set screws is provided to make said adjustment.

8. A processor according to claim 1 in which the portion of said resilient member which contacts the sheet is itself resilient.

9. A processor according to claim 1 in which said resilient member is resiliently biased toward a straight edge of said aperture.

10. A processor according to claim 1 in which a frame attachable to a structure is adapted removably to hold said tank.

11. A processor according to claim 1 in which the horizontal cross-section area of the tank is substantially less than the cross-section parallel to the said walls.

12. A processor according to claim 1 in which the sheet guide means includes a pair of flange members above said parallel slots, whereby to confine said sheets between them while the sheets are pressed past the guide members.

13. A processor according to claim 12 in which said sheet guide means includes a slot extending from the top thereof to an elevation at the bottom of the slot such that, when the top edge of the sheet is at said elevation, its bottom edge is correctly located above the bottom of the tank.

14. A processor according to claim 13 in which said sheet guide means includes a pair of openings with bottom portions at said elevation, whereby when the upper edge of the sheets are at said bottom edges, the sheets are squarely aligned with one another.

15. A processor according to claim 14 in which said parallel tank walls are surfaced by upwardly-entending ribs, which reduce the area of contact of said sheets against said wall to less than the total area of said sheets.

* * * * *